US009308536B2

(12) United States Patent
Nishijima et al.

(10) Patent No.: US 9,308,536 B2
(45) Date of Patent: Apr. 12, 2016

(54) METHOD AND APPARATUS FOR SEPARATION OF MIXTURE

(75) Inventors: Shigehiro Nishijima, Osaka (JP); Fumihito Mishima, Osaka (JP)

(73) Assignees: OSAKA UNIVERSITY, Osaka (JP); UBE INDUSTRIES, LTD., Yamaguchi (JP)

( * ) Notice: Subject to any disclaimer, the term of this patent is extended or adjusted under 35 U.S.C. 154(b) by 0 days.

(21) Appl. No.: 14/001,002

(22) PCT Filed: Feb. 21, 2012

(86) PCT No.: PCT/JP2012/054116
§ 371 (c)(1),
(2), (4) Date: Aug. 22, 2013

(87) PCT Pub. No.: WO2012/115100
PCT Pub. Date: Aug. 30, 2012

(65) Prior Publication Data

US 2013/0327684 A1 Dec. 12, 2013

(30) Foreign Application Priority Data

Feb. 23, 2011 (JP) ..... 2011-037013

(51) Int. Cl.
*B03C 1/32* (2006.01)
*B03C 1/03* (2006.01)
(Continued)

(52) U.S. Cl.
CPC ... *B03C 1/02* (2013.01); *B03B 5/30* (2013.01); *B03B 5/44* (2013.01); *B03C 1/0335* (2013.01); *B03C 1/288* (2013.01); *B03C 1/32* (2013.01); *B03C 2201/18* (2013.01)

(58) Field of Classification Search
CPC ..... B03C 1/025; B03C 1/32; B03C 1/002; B03C 2201/20; B03C 2201/22
USPC ..... 209/212, 214, 232, 39, 215, 223.1, 636
See application file for complete search history.

(56) References Cited

U.S. PATENT DOCUMENTS 4,828,685 A * 5/1989 Stephens ..... 505/400
5,268,353 A * 12/1993 Ohara et al. ..... 505/400
(Continued)

FOREIGN PATENT DOCUMENTS

JP 57-053258 A 3/1982
JP 60-39319 U 3/1985
(Continued)

OTHER PUBLICATIONS

Mori, T., "The application of magneto-Archimedes effect to the practical glass separation", Extended Abstracts (The 49th Spring Meeting, 2002); The Japan Society of Applied Physics and Related Societies (1), Mar. 27, 2002, p. 491.
(Continued)

*Primary Examiner* — Patrick Cicchino
(74) *Attorney, Agent, or Firm* — Eckert Seamans Cherin & Mellott, LLC; Carol A. Marmo; Grant E. Coffield

(57) ABSTRACT

The present invention provides a method and an apparatus capable of continuously and accurately separating, by type, a mixture containing at least two types of particles, or capable of separating specific particles from the mixture, using a gradient magnetic field. In the present invention, a mixture containing at least two types of particles, particles of one type of which are made of a paramagnetic or diamagnetic substance, is treated. A magnetic field whose magnetic field gradient has a vertical component and a horizontal component is applied to a supporting liquid 21 stored in a separating tank 31. When the mixture is placed into the supporting liquid 21, the particles of the one type are guided such that they are positioned in the supporting liquid 21 at a predetermined height from a bottom face 39 of the separating tank 31 while horizontally traveling. Alternatively, the particles of the one type magnetically levitate at a liquid surface of the supporting liquid 21 and horizontally travel. Particles of another type of the at least two types of particles are positioned at a position vertically different from that of the particles of the one type, between the bottom face 39 of the separating tank 31 and the liquid surface of the supporting liquid 21.

7 Claims, 11 Drawing Sheets

(51) Int. Cl.

| | |
|---|---|
| ***B03C 1/28*** | (2006.01) |
| ***B03C 1/02*** | (2006.01) |
| ***B03C 1/033*** | (2006.01) |
| ***B03B 5/30*** | (2006.01) |
| ***B03B 5/44*** | (2006.01) |

(56) References Cited

U.S. PATENT DOCUMENTS

| | | | | |
|---|---|---|---|---|
| 8,418,855 | B2 * | 4/2013 | Rem et al. | 209/39 |
| 2002/0153295 | A1 * | 10/2002 | Kimura et al. | 210/222 |
| 2010/0108578 | A1 * | 5/2010 | Dittmer et al. | 209/636 |
| 2011/0042274 | A1 * | 2/2011 | Rem et al. | 209/3 |

FOREIGN PATENT DOCUMENTS

| | | | |
|---|---|---|---|
| JP | 61-078375 | A | 4/1986 |
| JP | 63-307158 | A | 12/1988 |
| JP | 63-315159 | A | 12/1988 |
| JP | 64-022359 | A | 1/1989 |
| JP | 64-030659 | A | 2/1989 |
| JP | 64-34454 | A | 2/1989 |
| JP | 64-075036 | A | 3/1989 |
| JP | 01-304060 | A | 12/1989 |
| JP | 2002-59026 | A | 2/2002 |
| JP | 2010-517758 | A | 5/2010 |
| JP | 2010-524663 | A | 7/2010 |
| WO | 2011/049229 | A1 | 4/2011 |
| WO | WO 2014158016 | A1 * | 10/2014 |

OTHER PUBLICATIONS

Uetake, H., "Magneto-Archimedes separation in the coexistence with Lorentz force", Extended Abstracts (The 63rd Autumn Meeting, 2002); The Japan Society of Applied Physics 1 (1), Sep. 24, 2002, p. 414.

Mishima, F., et al., "High Gradient Superconducting Magnetic Separation for Iron Removal From the Glass Polishing Waste", IEEE Transactions on Applied Superconductivity, 21 (3), 2011, pp. 2059-2062.

Japanese Patent Office, "International Search Report", Apr. 17, 2012, 5 pp.

The International Bureau of WIPO, "English translation of International Preliminary Report on Patentability", Aug. 29, 2013, 5 pp.

* cited by examiner 15 wt% Aqueous solution of cobalt chloride (a)

15 wt% Aqueous solution of cobalt nitrate (b)

20 wt% Aqueous solution of nickel chloride (c)

15 wt% Aqueous solution of gadolinium nitrate (a)

15 wt% Aqueous solution of dysprosium nitrate (b)

15 wt% Aqueous solution of terbium nitrate (c)

(a)

20 wt% Aqueous solution of nickel nitrate (b)

10 wt% Aqueous solution of ferrous chloride (c)

15 wt% Aqueous solution of manganese chloride

FIG. 15
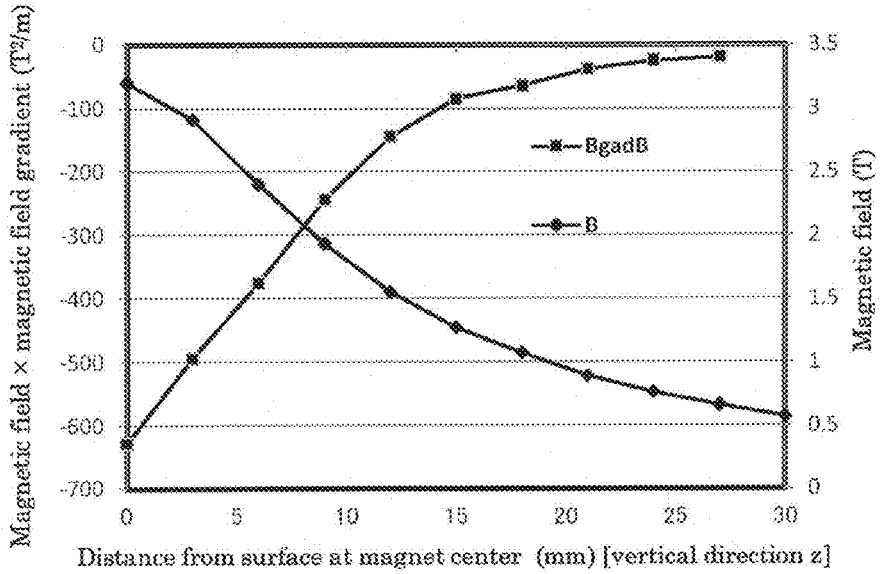
FIG. 16
| Position (mm) | 0 | 3 | 6 | 9 | 12 | 15 | 18 | 21 | 24 | 27 | 30 |
|---|---|---|---|---|---|---|---|---|---|---|---|
| Magnetic field (T) | 3.20 | 2.91 | 2.40 | 1.93 | 1.55 | 1.27 | 1.07 | 0.89 | 0.76 | 0.66 | 0.57 |
| Magnetic field gradient (T/m) | -197 | -170 | -157 | -127 | -93 | -67 | -60 | -43 | -33 | -30 | — |
| Magnetic field × magnetic field gradient (T²/m) | -629.3 | -494.7 | -376.8 | -244.5 | -144.7 | -84.7 | -64.2 | -38.6 | -25.3 | -19.8 | — |
FIG. 17
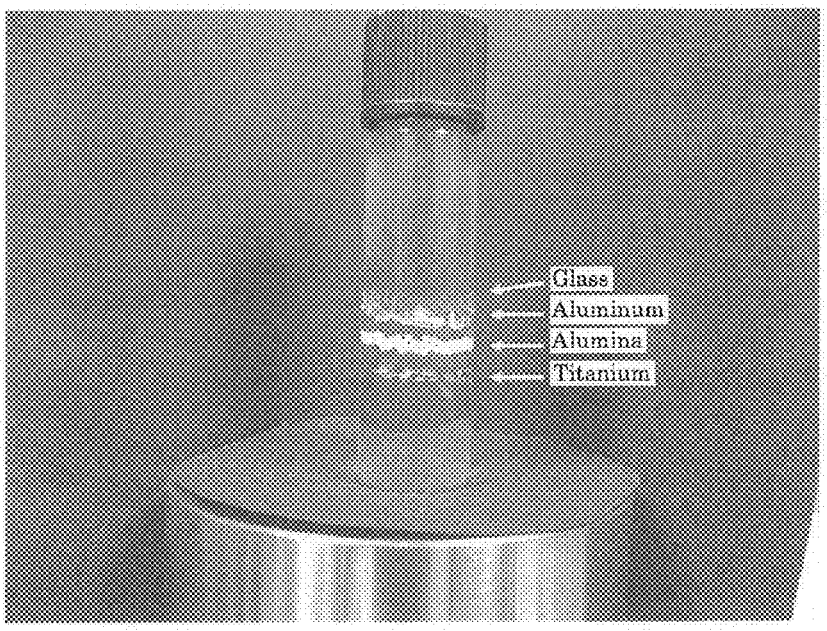

METHOD AND APPARATUS FOR SEPARATION OF MIXTURE

FIELD OF THE INVENTION

The present invention relates to a mixture separating method and a mixture separating apparatus for separating, by substance type, a mixture containing a plurality of types of substances, or for separating a specific type of substance from the mixture, using a magnetic field having a magnetic field gradient.

BACKGROUND OF THE INVENTION

When collecting metals or resins from waste such as a used electronic product including the metals or resins as the builders, typically, various separating processes are performed on a mixture of different types of substances obtained by grinding the waste or part thereof. For example, Patent Document 1 (JP 2010-524663A discloses a recycling method, including a process that places shredder residue obtained from waste into a sink-float tank, and separates the residue into metal residue and plastic residue using the difference in density or specific gravity, a process that separates, by type, the metal residue using an air separator, a magnetic belt, or the like, and a process that separates, by type, the plastic residue using a temperature separator, a hydrocyclone, or the like.

The method disclosed in Patent Document 1 employs a plurality of separators, tanks, and the like in order to realize the above-described separating processes, and thus, a complicated and large-scale system is necessary for realizing this method. Meanwhile, Patent Document 2 (JP 2002-59026A) discloses a method for sorting a mixture using the magneto-Archimedes effect. According to this method, a mixture of a plurality of types of diamagnetic plastic particles is placed into a supporting liquid, and a magnetic field having a magnetic field gradient, that is, a gradient magnetic field is applied thereto, so that the diamagnetic plastic particles in the mixture float at positions corresponding to their physical properties (volume susceptibility and density), and the plastic particles are sorted by type. If a mixture containing a plurality of types of substances, such as a mixture obtained from waste as disclosed in Patent Document 1, is separated by type using the magneto-Archimedes effect (or magnetic force or magnetic buoyancy applied to particles in a medium) as in the invention described in Patent Document 2, the separating apparatus and the separating process will be significantly simplified and more efficient.

PRIOR ART REFERENCES

Patent Documents

Patent Document 1: JP 2010-524663A
Patent Document 2: JP 2002-59026A

DISCLOSURE OF THE INVENTION

Problems to be Solved by the Invention

However, with the approach shown in FIGS. 1 to 3 of Patent Document 2, it is difficult to perform continuous treatment that involves collecting particles separated by type while placing a mixture into a supporting liquid. Although FIG. 4 of Patent Document 2 shows the approach that causes a supporting liquid to flow and collects magnetically levitating particles using a collecting net, the accuracy in separating particles may possibly deteriorate when positions for trapping the particles are changed by a disturbance (turbulence, meandering of the flow line, etc.) in the flow of the supporting liquid. Furthermore, if a plurality of collecting nets are arranged in series along the channel as shown in FIG. 4 of Patent Document 2, the accuracy in separating particles at a downstream collecting net may deteriorate due to the influence of a disturbance caused by an upstream collecting net. If the mixture contains high-density metal particles, the metal particles that have sunk to the bottom of the channel have to be washed along, and thus, the above-described problems occur more easily.

The present invention solves the above-described problems, and provides a method and an apparatus capable of continuously and accurately separating, by substance type, a mixture containing a plurality of types of particles made of different substances, using a gradient magnetic field. Moreover, the present invention provides a method and an apparatus capable of continuously and accurately separating particles made of a specific substance from a mixture containing a plurality of types of particles made of different substances, using a gradient magnetic field.

Means for Solving the Problems

The present invention is directed to a mixture separating method for separating, by type, a mixture containing at least two types of particles, particles of one type of which are made of a paramagnetic or diamagnetic substance, or for separating the particles of the one type from the mixture, including: a step of applying a magnetic field whose magnetic field gradient has a vertical component and a horizontal component to a supporting liquid stored in a separating tank; a step of placing the mixture into the supporting liquid to which the magnetic field has been applied, and guiding the particles of the one type using the magnetic field such that the particles of the one type are positioned in the supporting liquid at a predetermined height from a bottom face of the separating tank while horizontally traveling, or a step of placing the mixture into the supporting liquid to which the magnetic field has been applied, and causing the particles of the one type to magnetically levitate at a liquid surface of the supporting liquid and horizontally travel using the magnetic field; and a step of collecting the particles of the one type positioned at the predetermined height or at the liquid surface of the supporting liquid, wherein particles of another type of the at least two types of particles are positioned at a position vertically different from that of the particles of the one type, between the bottom face of the separating tank and the liquid surface of the supporting liquid.

Moreover, the present invention is directed to a mixture separating apparatus for separating, by type, a mixture containing at least two types of particles, particles of one type of which are made of a paramagnetic or diamagnetic substance, or for separating the particles of the one type from the mixture, including: a separating tank for storing a supporting liquid; magnetic field generating means for applying a magnetic field whose magnetic field gradient has a vertical component and a horizontal component to the supporting liquid; introducing means for introducing the mixture into the supporting liquid, said means being disposed at one end side of the separating tank; and collecting means for collecting the particles of the one type, said means being disposed at the other end side of the separating tank, wherein, when the mixture is introduced via the introducing means into the supporting liquid to which the magnetic field has been applied, the particles of the one type are guided using the magnetic field such that the particles of the one type are positioned in the supporting liquid at a predetermined height from a bottom face of the separating tank while traveling toward the other end side of the separating tank, or the particles of the one type are caused to magnetically levitate at a liquid surface of the supporting liquid and travel toward the other end side of the separating tank using the magnetic field, the collecting means collects the particles of the one type positioned at the predetermined height or at the liquid surface of the supporting liquid, from the separating tank, and particles of another type of the at least two types of particles are positioned at a position vertically different from that of the particles of the one type, between the bottom face of the separating tank and the liquid surface of the supporting liquid.

The present invention may be configured such that the separating tank is provided with a substantially horizontal shelf board, and the particles of the one type sink in the supporting liquid and are positioned on the shelf board. Furthermore, the invention may be configured such that the particles of the one type magnetically levitate stably at the predetermined height in the supporting liquid.

The present invention may be configured such that the magnetic field is generated using magnetic field generating means having a superconducting bulk magnet or having a solenoid coil with a coil central axis inclined with respect to the vertical direction. Furthermore, the invention may be configured such that the magnetic field is obtained by composition of a first magnetic field generated by first magnetic field generating means and a second magnetic field generated by second magnetic field generating means, and the first magnetic field has a magnetic field gradient oriented in the vertical direction and the second magnetic field has a magnetic field gradient oriented in the horizontal direction.

The present invention may be configured such that the supporting liquid is an aqueous solution containing at least one type of paramagnetic inorganic salt, and more specifically such that the supporting liquid is an aqueous solution containing at least one type of paramagnetic inorganic salt selected from the group consisting of manganese chloride, cobalt chloride, nickel chloride, ferrous chloride, cobalt nitrate, nickel nitrate, gadolinium nitrate, dysprosium nitrate, and terbium nitrate.

Advantageous Effects of the Invention

In the present invention, the magnetic field gradient of the magnetic field that is to be applied to the particles contained in the mixture and to the supporting liquid has a horizontal component in addition to a vertical component. Accordingly, a horizontal force resulting from this magnetic field is applied to paramagnetic or diamagnetic particles contained in the mixture, and these particles are guided to a predetermined height from the bottom face of the separating tank while horizontally traveling from the placing or introducing location to the collecting location, or horizontally travel from the placing location to the collecting location while magnetically levitating at the liquid surface of the supporting liquid. Since the trajectories of the particles in the supporting liquid vary depending on the physical properties of the particles, the magnetic or diamagnetic particles and the other particles contained in the mixture are positioned at vertically different heights between the bottom face of the separating tank and the liquid surface of the supporting liquid.

In this manner, according to the present invention, the particles in the mixture are caused to travel from the location for placing into the supporting liquid to the collecting location by the magnetic force, and thus, it is possible to collect the separated particles while the mixture is being introduced into the supporting liquid. Furthermore, the supporting liquid does not have to flow along in order to cause the particles to travel, and thus, it is possible to accurately separate the mixture by type, or to accurately separate a specific type of particle from the mixture.

BRIEF DESCRIPTION OF THE DRAWINGS

FIG. 15 is a graph showing distribution of a magnetic field generated by a superconducting bulk magnet used in an experiment relating to the present invention and distribution of a product of the magnetic field and its magnetic field gradient.

FIG. 16 is a table showing the values of a magnetic field generated by the superconducting bulk magnet used in the experiment relating to the present invention, the magnetic field gradient, and the product of the magnetic field and the magnetic field gradient.

FIG. 17 is a photograph showing a state in which aluminum particles, titanium particles, alumina particles, and glass particles float in the supporting liquid in the experiment relating to the present invention.

DETAILED DESCRIPTION OF THE INVENTION

Figure 1:
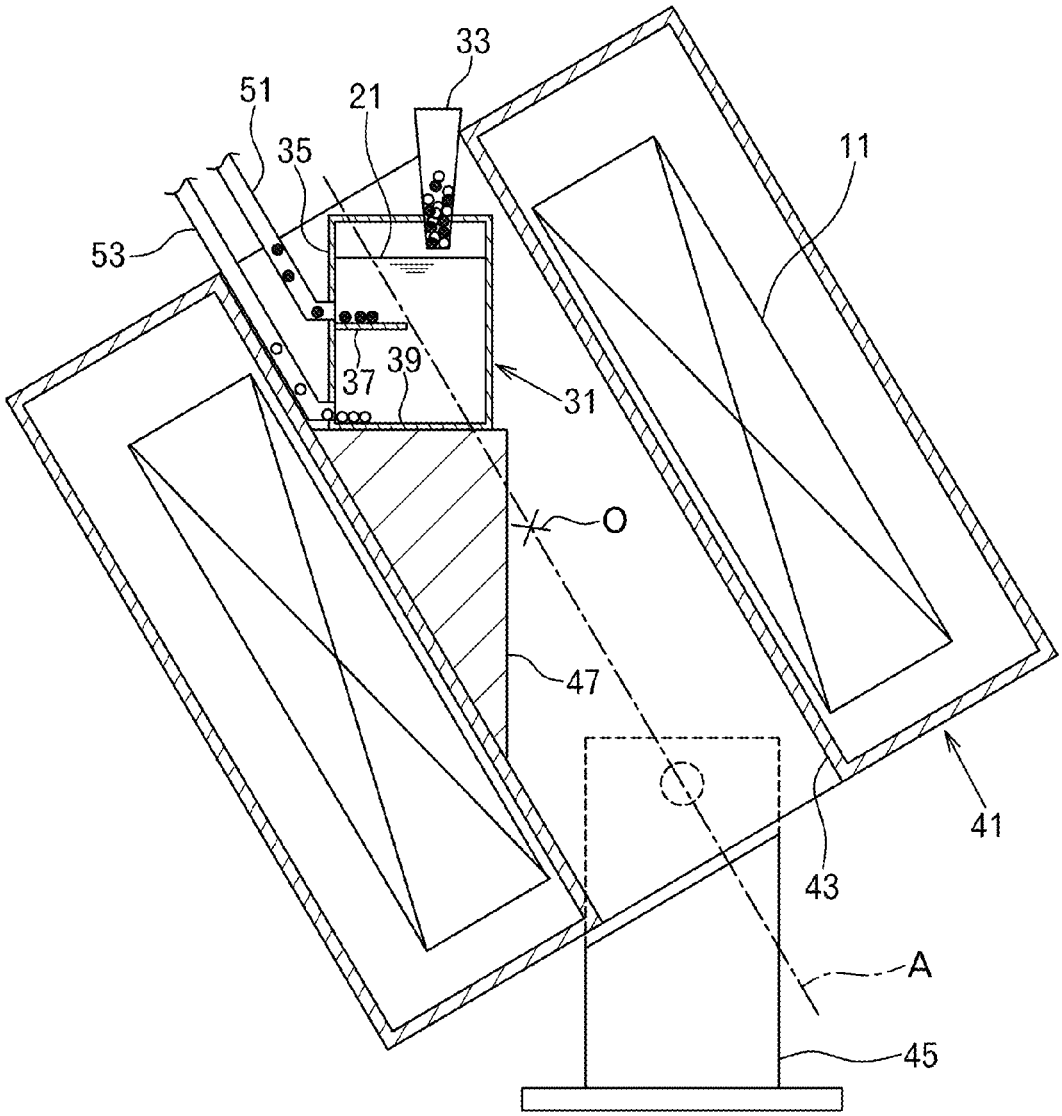
FIG. 1 is a cross-sectional view showing the outline of a mixture separating apparatus according to a first embodiment of the present invention.

Hereinafter, embodiments of the present invention will be described with reference to the drawings. In the following description and the appended drawings, the same or similar portions or constituent elements are denoted by the same reference numerals.

Figure 2:
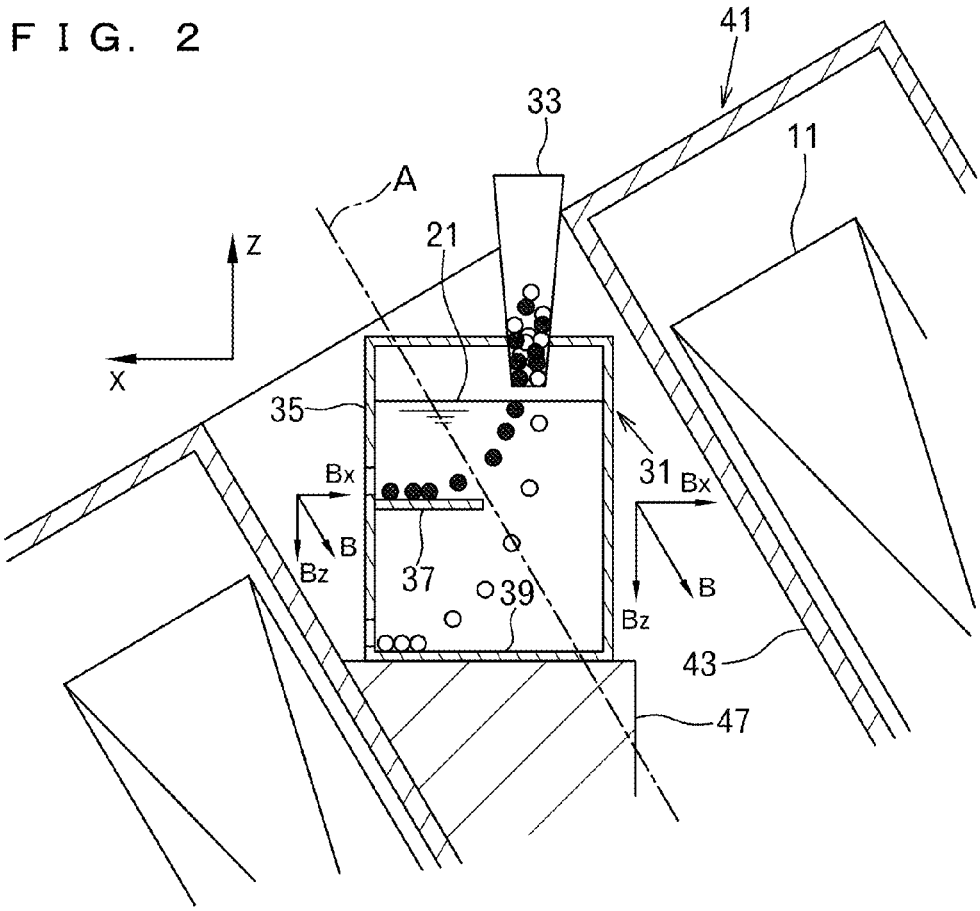
FIG. 2 is a cross-sectional view showing the outline of the mixture separating apparatus according to the first embodiment of the present invention.

FIG. 1 is a cross-sectional view showing the outline of a mixture separating apparatus according to a first embodiment of the separating method or the separating apparatus of the present invention. FIG. 2 is a partially enlarged view of this mixture separating apparatus. The mixture separating apparatus of the first embodiment includes a magnet (11) that is magnetic field generating means of the present invention and generates a gradient magnetic field, and a separating tank (31) for storing a supporting liquid (21). The magnet (11) is a superconducting magnet using a solenoid coil, and a wire member made of a superconducting material ($Nb_3Sn$, NbTi, etc.) forming the magnet (11) is wound inside a cylindrical or doughnut-like container (41) made of stainless steel or the like so as to cover an inner wall (43) of the container (41). Inside the container (41), a cooling mechanism (not shown) that cools down the magnet (11) is provided. A non-superconducting electromagnet also may be used as the magnet (11).

The mixture separating apparatus of the first embodiment is provided with a leg portion (45) that supports the container (41). The container (41) is fixed to the leg portion (45) in a state in which a coil central axis A of the magnet (11) is inclined with respect to the vertical direction. FIGS. 1 and 2 show a state in which the coil central axis A of the magnet (11) is inclined by approximately 30 degrees with respect to the vertical direction. The inclination angle of the magnet (11) (and the shape of a support portion (47) described later) may be adjusted as appropriate according to the mixture that is to be treated and the supporting liquid (21) that is to be used.

Figure 3:
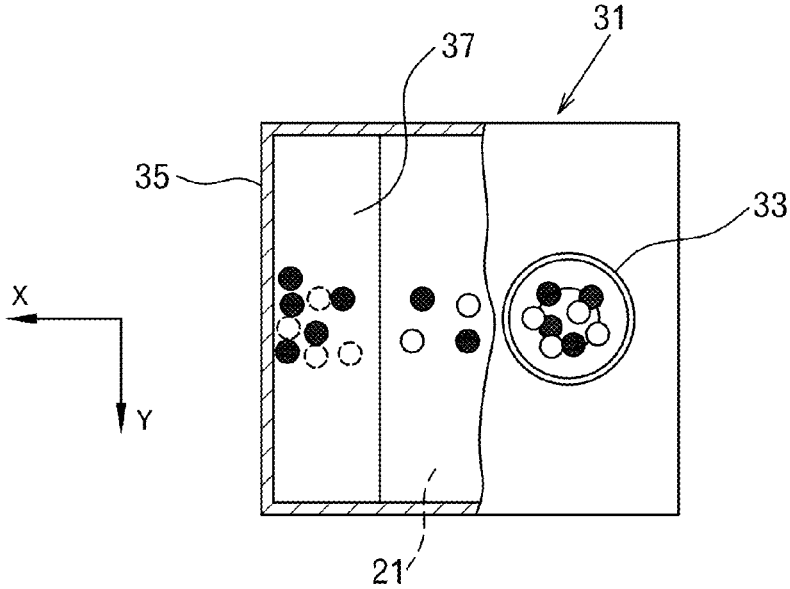
FIG. 3 is a partially cutaway top view of a separating tank of the mixture separating apparatus according to the first embodiment of the present invention.

The separating tank (31) in the shape of a rectangular solid or a box is disposed in the internal space surrounded by the inner wall (43) of the container (41). The separating tank (31) is supported on the support portion (47) fixed to the inner wall (43) of the container (41). The separating tank (31) and the support portion (47) are made of a non-magnetic material such as plastic or non-magnetic stainless steel. In an upper portion of the separating tank (31) at one end side, a hopper (33) is provided that is means for throwing or introducing a mixture, and that is used to place a mixture that is to be treated into the supporting liquid (21) in the separating tank (31). A shelf board (37) is provided so as to horizontally project from a wall portion (35) that is on the opposite side to the hopper (33). FIG. 3 is a partially cutaway top view of the separating tank (31).

A mixture that is to be treated using the mixture separating method or the mixture separating apparatus of the present invention contains a plurality of types of particles made of different substances. In the plurality of types of particles, at least one type of particle is made of a paramagnetic or diamagnetic substance. The mixture that is to be treated using the mixture separating apparatus of the first embodiment contains first particles (indicated by black circles) made of a paramagnetic or diamagnetic substance and second particles (indicated by white circles) made of a substance different from the substance forming the first particles. The second type of particle may be made of any one of a paramagnetic substance, a diamagnetic substance, and a ferromagnetic substance.

The separating tank (31) is linked to collecting means for separately collecting the first particles and the second particles that have been separated from each other. The mixture separating apparatus of the first embodiment is provided with a suction tube (51) that collects the first particles and a suction tube (53) that collects the second particles (the suction tubes (51) and (53) are omitted in FIGS. 2 and 3). Each of the suction tubes (51) and (53) is linked to the separating tank (31) via a hole formed through the wall portion (35) of the separating tank (31). Each of the suction tubes (51) and (53) has an end provided with a suction pump, a tank for storing collected particles, and the like (not shown).

Figure 4:
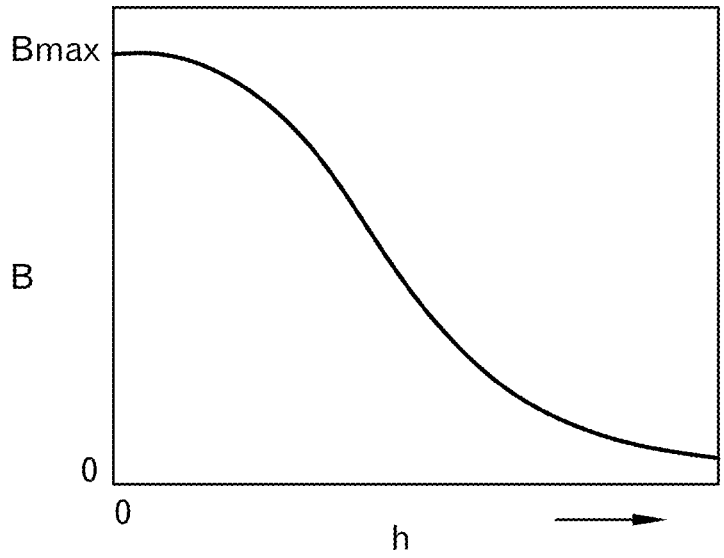
FIG. 4 is a graph showing a magnetic field generated by magnetic field generating means used by the mixture separating apparatus according to the first embodiment of the present invention.

As is well known, when electricity is supplied to the solenoid coil of the magnet (11), a magnetic field is generated along the coil central axis A of the magnet (11). FIG. 4 shows a change in a magnetic field B generated by the magnet (11), with respect to a distance h from a center O of the magnet (11) along the central axis A of the magnet (11) (where the upward orientation along the coil central axis A is taken as positive). The magnitude B of the magnetic field reaches a maximum value Bmax when h=0, that is, at the center O of the magnet (11), and monotonically decreases as the distance h increases. The magnitude B of the magnetic field is substantially constant on a plane orthogonal to the coil central axis A. Hereinafter, a description will be given assuming that a magnetic field generated by the magnet (11) is oriented downward along the coil central axis A, but the magnetic field generated by the magnet (11) may be oriented upward along the coil central axis A.

Figure 5:
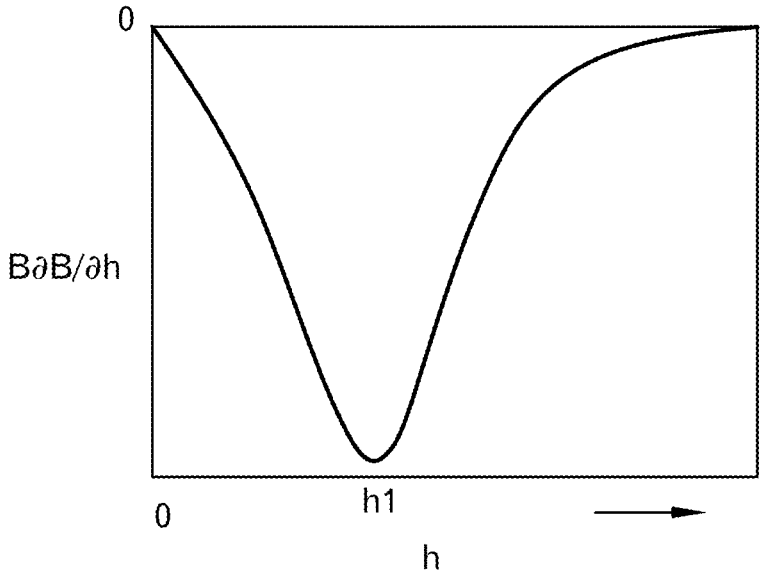
FIG. 5 is a graph showing a product of the magnetic field generated by the magnetic field generating means used by the mixture separating apparatus and the magnetic field gradient according to the first embodiment of the present invention.

FIG. 5 shows a change in a product of the magnitude B of the magnetic field generated by the magnet (11) and a magnetic field gradient $\partial B/\partial h$, that is, $B\times\partial B/\partial h$ with respect to the distance h. As the distance h increases, the magnitude B of the magnetic field decreases, and thus, the magnetic field gradient $\partial B/\partial h$ becomes negative, and $B\times\partial B/\partial h$ also becomes negative. The product $B\times\partial B/\partial h$ is zero when h=0, that is, at the center O of the magnet (11), and decreases once and then increases as h increases from 0. The separating tank (31) is preferably disposed apart from the center O of the magnet (11) by the distance h at which $B\times\partial B/\partial h$ reaches a local minimum value.

Since the coil central axis A of the magnet (11) is inclined with respect to the vertical direction, the magnetic field generated by the magnet (11) has a vertical component (Bz) and a horizontal component (Bx). In the description below, as shown in FIG. 2, the vertical direction is taken as a z axis, and the axis along the horizontal component of the magnetic field is taken as an x axis. Furthermore, a y axis is set as shown in FIG. 3 (a similar coordinate system is also used in FIGS. 6 and 7 described below).

A force resulting from the magnetic field generated by the magnet (11) and represented by the following equation acts per unit volume on the first particles and the second particles in the supporting liquid (21).

$$F=(\chi_i-\chi_0)(B\cdot\nabla)B/\mu_0$$

where, $\mu_0$ is the permeability in vacuum, $\chi_i$ is the volume susceptibility of the first particles or the second particles (i is 1 or 2), and $\chi_0$ is the volume susceptibility of the supporting liquid (21). In this equation, the force F and the magnetic field B are vectors.

Since the coil central axis A of the magnet (11) is inclined with respect to the vertical direction, the magnetic field generated by the magnet (11) has a magnetic field gradient in the horizontal direction, that is, in the x axis-direction in addition to a magnetic field gradient in the vertical direction, that is, in the z axis-direction. In other words, the magnetic field gradient of the magnetic field generated by the magnet (11) has a vertical component and a horizontal component, that is, a z direction-component and an x direction-component. Accordingly, also considering the effect of the gravity, a force Fx in the x direction and a force Fz in the z direction acting on the first particles or the second particles in the supporting liquid (21) are as follows.

$$F_x=(\chi_i-\chi_0)[(B\cdot\nabla)B]_x/\mu_0$$

$$F_z=-(\rho_i-\rho_0)g+(\chi_i-\chi_0)[(B\cdot\nabla)B]_z/\mu_0$$

where, g is the acceleration of gravity, $\rho_i$ is the density (specific gravity) of the first particles or the second particles (i is 1 or 2), and $\rho_0$ is the density (specific gravity) of the supporting liquid.

As shown in FIG. 2, the z component Bz and the x component Bx of the magnetic field are negative. Furthermore, the magnetic field monotonically increases in the positive direction of the Bx axis for the x component of the magnetic field ($\partial Bx/\partial x$ is positive), and monotonically increases in the positive direction of the z axis ($\partial Bz/\partial z$ is positive). Accordingly, $[(B\cdot\nabla V)B]_x$ in the above equation for Fx is negative, so that if the supporting liquid (21) is selected such that $(\chi_i-\chi_0)<0$ for both of the first particles and the second particles, the first particles and the second particles can be caused to travel in the positive direction of the x axis. That is to say, the first particles and the second particles placed or introduced via the hopper (33) into the supporting liquid (21) can be caused to travel from the hopper (33) toward the wall portion (35) of the separating tank (31) or the suction tubes (51) and (53).

Moreover, the supporting liquid (21) is selected such that not only $(\chi_i-\chi_0)<0$ but also $(\rho_i-\rho_0)>0$ for both of the first particles and the second particles. According to the above equation for Fz, if $(\rho_i-\rho_0)g>(\chi_i-\chi_0)[(B\cdot\nabla)B]_z/\mu_0$, a force in the negative direction of the z axis, that is, in the vertically downward orientation acts on the first particles or the second particles. Furthermore, if $(\rho_i-\rho_0)g<(\chi_i-\chi_0)[(B\cdot\nabla)B]_z/\mu_0$, a vertically upward force acts on the first particles or the second particles. If $(\rho_i-\rho_0)g=(\chi_i-\chi_0)[(B\cdot\nabla)B]_z/\mu_0$, a force in the vertical direction that acts on the first particles or the second particles becomes 0, and the first particles or the second particles are in a floating state due to a so-called magneto-Archimedes effect.

The first particles or the second particles placed into the supporting liquid (21) travel or move in the supporting liquid (21) so as to obtain or maintain the floating state (Fz=0) due to the magneto-Archimedes effect. Accordingly, the first particles placed via the hopper (33) travel toward the wall portion (35) of the separating tank (31) along a substantially similar trajectory in the supporting liquid (21). Also, the second particles placed via the hopper (33) travel toward the wall portion (35) along a substantially similar trajectory in the supporting liquid (21). Since the trajectories of the first particles and the second particles in the supporting liquid (21) vary depending on a difference in the density and the volume susceptibility between the first particles and the second particles, the first particles and the second particles are ultimately guided to mutually different heights, positions, or locations in the z direction, while traveling in the x direction in the supporting liquid (21).

That is to say, if the supporting liquid (21) is selected such that not only $(\chi_i\chi_0)<0$ but also $(\chi_i-\chi_0)>0$ for both of the first particles and the second particles, and the magnetic field generated by the magnet (11) or the magnitude of a current that flows through the magnet (11) is adjusted as appropriate, the first particles and the second particles can be separated in the z direction while traveling in the x direction in the supporting liquid (21) as shown in the example in FIGS. 1 to 3.

In order to put the first particles and the second particles in a magneto-Archimedes floating state, it is preferable to use a paramagnetic liquid having a large absolute value of the volume susceptibility as the supporting liquid (21). Examples of such a paramagnetic liquid include aqueous solutions of paramagnetic inorganic salts such as manganese chloride, cobalt chloride, nickel chloride, ferrous chloride, cobalt nitrate, nickel nitrate, gadolinium nitrate, dysprosium nitrate, and terbium nitrate. The supporting liquid may be an aqueous solution containing a plurality of types of paramagnetic inorganic salts. The trajectories of the first particles and the second particles in the supporting liquid (21) can be controlled or adjusted by adjusting the concentration of paramagnetic inorganic salt contained in the aqueous solution.

In the example shown in FIGS. 1 to 3, each of the first particles placed via the hopper (33) sinks while traveling in the x direction in the supporting liquid (21), reaches the shelf board (37) provided so as to horizontally project from the wall portion (35), and then travels on the shelf board (37) toward the wall portion (35). The shelf board (37) restricts or regulates the travel of the first particles in the z direction. The length in the x direction of the shelf board (37) is determined as appropriate considering the trajectory of the first particles in the supporting liquid (21). An end portion of the suction tube (51) is disposed close to the upper face of the shelf board (37), and the first particles on the shelf board (37) are sucked out of the separating tank (31) by the suction tube (51) for collecting the first particles. The supporting liquid (21) sucked together with the first particles into the suction tube (51) is preferably returned to the separating tank (31) after being separated from the first particles. The shelf board (37) may be disposed substantially in the horizontal direction, or may be disposed slightly inclined, for example, so as to extend upward or downward toward the wall portion (35).

Furthermore, in the example shown in FIGS. 1 to 3, each of the second particles placed via the hopper (33) also sinks while traveling in the x direction in the supporting liquid (21), reaches a bottom face (39) of the separating tank (31), and then travels on the bottom face (39) of the separating tank (31) toward the wall portion (35). The bottom face (39) restricts the travel of the second particles in the z direction. The bottom face (39) may be disposed substantially in the horizontal direction, or may be disposed slightly inclined, for example, so as to extend upward or downward toward the wall portion (35). An end portion of the suction tube (53) is disposed close to the bottom face (39) of the separating tank (31), and the second particles on the bottom face (39) are sucked out of the separating tank (31) by the suction tube (53) for collecting the second particles. The supporting liquid (21) sucked together with the second particles into the suction tube (53) is preferably returned to the separating tank (31) after being separated from the second particles. It is also possible to additionally provide a shelf board below the shelf board (37), and allow the second particles to travel horizontally on that shelf board.

With the mixture separating apparatus according to the first embodiment, the first particles may be allowed to sink while traveling horizontally and reach the wall portion (35), and then be put in a magneto-Archimedes floating state at the wall portion (35), by adjusting the gradient magnetic field and/or the volume susceptibility or the density of the supporting liquid (21) (if using an aqueous solution of a paramagnetic inorganic salt as the supporting liquid (21), the concentration thereof). If the first particles that have reached the wall portion (35) can obtain a magneto-Archimedes floating state, the first particles floating stably at the position on the z axis corresponding to Fz=0 in the supporting liquid (21) can be collected without providing the shelf board (37) described above. Note that, even in this case, in order to improve the accuracy in separating the first particles and the second particles, the shelf board (37) may be provided corresponding to the position (slightly below the position) where the particles flow due to the magneto-Archimedes effect. Furthermore, the second particles also may be allowed to sink while horizontally traveling, reach the wall portion (35), and be put in a magneto-Archimedes floating state at a height different from that of the first particles.

Figure 6:
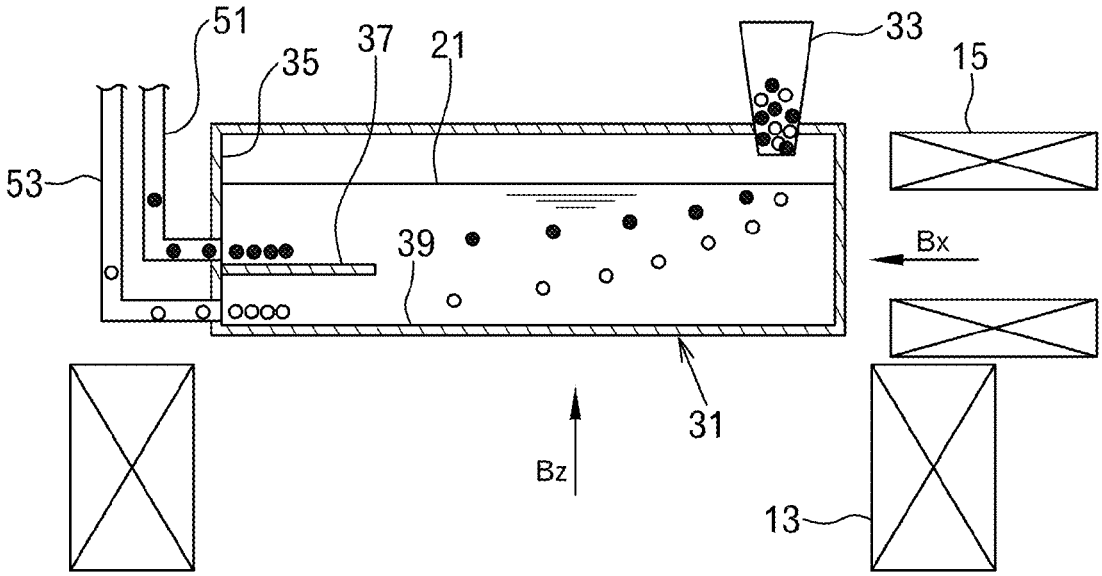
FIG. 6 is a cross-sectional view showing the outline of a mixture separating apparatus according to a second embodiment of the present invention.

FIG. 6 is a cross-sectional view showing the outline of a mixture separating apparatus according to a second embodiment of the separating method or the separating apparatus of the present invention. The mixture separating apparatus according to the second embodiment includes a first magnet (13) that causes the particles in the mixture to levitate or float in the supporting liquid (21), and a second magnet (15) that causes the particles in the mixture to travel horizontally in the supporting liquid (21). The gradient magnetic field that is to be applied to the supporting liquid (21) is generated by composition of the gradient magnetic field of the first magnet (13) and the gradient magnetic field of the second magnet (15). The first magnet (13) is disposed below the separating tank (31) in the shape of a rectangular solid or a box that stores the supporting liquid (21), and applies, to the supporting liquid (21) in the separating tank (31), a vertical gradient magnetic field in which the magnitude monotonically decreases toward the vertically upper side. The gradient magnetic field generated by the first magnet (13) is uniform or substantially uniform along the horizontal direction in the separating tank (31). The second magnet (15) is disposed at one end side of the separating tank (31), and applies, to the supporting liquid (21) in the separating tank (31), a horizontal gradient magnetic field in which the magnitude monotonically decreases toward the other end side of the separating tank (31). The gradient magnetic field generated by the second magnet (15) is uniform or substantially uniform along the vertical direction in the separating tank (31). As the first magnet (13) and the second magnet (15), for example, a superconducting magnet using a solenoid coil is used, but a non-superconducting electromagnet also may be used. A description of the configuration for arranging the separating tank (31), the first magnet (13), and the second magnet (15) as shown in FIG. 6 has been omitted.

The one end side, that is, the side closer to the second magnet (15) in the upper portion of the separating tank (31) is provided with the hopper (33) for throwing a mixture. FIG. 6 shows, as an example, a state in which a mixture containing the first particles (indicated by black circles) and the second particles (indicated by white circles) is placed into the supporting liquid (21) as in the case of the foregoing drawings. As in the case described above, the supporting liquid (21) is selected such that not only $(\chi_i-\chi_0)<0$ but also $(\rho_i-\rho_0)>0$ for both of the first particles and the second particles. The first particles and the second particles are allowed to sink while traveling in the horizontal direction (the x direction) in the supporting liquid (21), as in the first embodiment of the present invention, by adjusting the gradient magnetic field generated by the magnets (13) and (15) or the magnitude of a current that flows through magnets (13) and (15). In the example shown in FIG. 6, the first particles and the second particles are in a magneto-Archimedes floating state in the vicinity of the wall portion (35), wherein the first particles float near the upper face of the shelf board (37), and the second particles float near the bottom face (39) of the separating tank (31). As in the case described above, the first particles and the second particles that levitate are separately collected from the separating tank (31) using the suction tubes (51) and (53).

Whereas the mixture separating apparatus of the first embodiment is such that the force in the z direction and the force in the x direction applied to the first particles and the second particles in the supporting liquid (21) are changed together by adjusting a current that flows through the magnet (11), the mixture separating apparatus according to the second embodiment is such that the force in the z direction applied to the first particles and the second particles can be adjusted by adjusting a current that flows through the first magnet (13), and the force in the x direction applied to the first particles and the second particles can be adjusted by adjusting a current that flows through the second magnet (15). The force in the x direction may be intermittently applied to the first particles and the second particles by causing a current to intermittently (e.g., in a pulse-like manner) flow through the second magnet (15).

Figure 7:
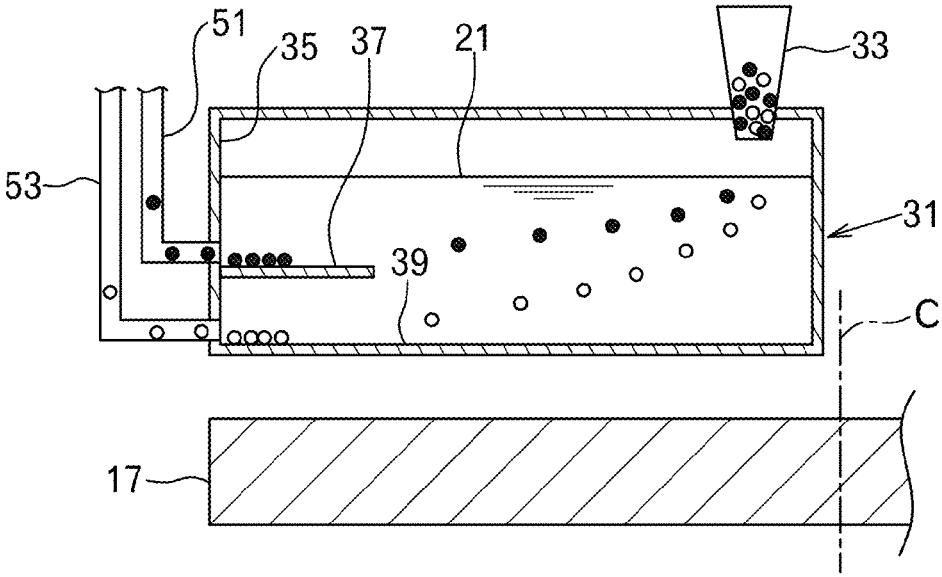
FIG. 7 is a cross-sectional view showing the outline of a mixture separating apparatus according to a third embodiment of the present invention.

Although the gradient magnetic field that is to be applied to the particles in the mixture is generated using electromagnets in the first embodiment and the second embodiment of the present invention, the present invention can be implemented using superconducting bulk magnets or permanent magnets. FIG. 7 is a cross-sectional view showing the outline of a mixture separating apparatus according to a third embodiment of the separating method or the separating apparatus of the present invention. The mixture separating apparatus according to the third embodiment uses a superconducting bulk magnet (17) to generate a gradient magnetic field for separating, by type, the particles in the mixture while causing the particles to horizontally travel.

The superconducting bulk magnet (17) is in the shape of a column, and the separating tank (31) approximately in the shape of a rectangular solid or a box is disposed over a circular pole end face of the magnet (17). The separating tank (31) is disposed such that its longitudinal direction is along the radial direction of the pole end face of the magnet (17). One end of the separating tank (31) is disposed in the vicinity of a central axis C of the superconducting bulk magnet (17), and the other end (the wall portion (35)) of the separating tank (31) is disposed in the vicinity of the outer edge of the superconducting bulk magnet (17). The position of the separating tank (31) with respect to the superconducting bulk magnet (17) may be adjusted or changed as appropriate.

The one end side, that is, the side closer to the central axis C of the superconducting bulk magnet (17) in the upper portion of the separating tank (31) is provided with the hopper (33) for placing a mixture. FIG. 7 shows, as an example, a state in which a mixture containing the first particles (indicated by black circles) and the second particles (indicated by white circles) is placed into the supporting liquid (21) as in the case of the foregoing drawings. As in the first embodiment and the second embodiment, the supporting liquid (21) is selected such that not only $(\chi_i-\chi_0)<0$ but also $(\rho_i-\rho_0)>0$ for both of the first particles and the second particles.

The superconducting bulk magnet (17) generates a magnetic field that is axisymmetric about the central axis C. The magnitude of the magnetic field decreases away in the vertical direction from the pole end face of the magnet (17) or away in the horizontal direction (in the radial direction) from the central axis C of the magnet (17). Accordingly, the superconducting bulk magnet (17) applies, to the first particles and the second particles in the supporting liquid (21), the force Fx in the horizontal direction (the x direction) and the force Fz in the vertical direction (the z direction) represented by the equations above. As in the first and the second embodiments, the first particles and the second particles can be separated by allowing the first particles and the second particles in the supporting liquid (21) to sink while traveling in the horizontal direction (the x direction) and reach different positions in the vertical direction (the z direction).

As in the first embodiment, the first particles are gathered on the shelf board (37), and are collected from the separating tank (31) using the suction tube (51). Furthermore, the second particles are gathered on the bottom face (39) of the separating tank (31), and are collected from the separating tank (31) using the suction tube (53). The mixture separating apparatus according to the third embodiment also may be such that the first particles are caused to reach the wall portion (35) and be put in a magneto-Archimedes floating state, by adjusting the gradient magnetic field and/or the volume susceptibility or the density of the supporting liquid (21). The second particles also may be caused to reach the wall portion (35) and be put in a magneto-Archimedes floating state.

The separating tank (31) of the mixture separating apparatus of the third embodiment may be in the shape of a cylinder, the hopper (33) may be disposed at the center of a circular upper face of the separating tank (31), and the separating tank (31) may be disposed over the superconducting bulk magnet (17) such that the central axis of the separating tank (31) or the hopper (33) is along the central axis C of the superconducting bulk magnet (17). In this case, the shelf board (37) in the shape of a ring is provided so as to project inward from the wall portion of the separating tank (31). In such a modified mixture separating apparatus of the third embodiment, the first particles and the second particles placed via the hopper (33) into the supporting liquid (21) sink while traveling in the direction perpendicular to the central axis C (i.e., in the radial direction of the pole end face of the magnet (17)) in the supporting liquid (21). That is to say, the first particles and the second particles in the mixture continuously placed into the supporting liquid (21) are diffused radially from the central axis C of the magnet (17).

The trajectories of the first particles and the second particles described as an example of the first to the third embodiments with reference to FIGS. 1 to 3, 6, and 7 are such that the second particles are ultimately positioned below the first particles. However, for example, if the second particles have a very small density ($(\rho_2-\rho_0)<0$), the second particles will travel toward the wall portion (35) while floating at the liquid surface of the supporting liquid (21).

The trajectories of the first particles and the second particles described as an example of the first to the third embodiments with reference to FIGS. 1 to 3, 6, and 7 are such that the first particles sink while horizontally traveling, and reach the shelf board (37) or a predetermined height from the bottom face (39) of the separating tank (31) in the supporting liquid (21). However, the first particles placed via the hopper (33) may horizontally travel to the wall portion (35) of the separating tank (31) while magnetically levitating at the liquid surface of the supporting liquid (21). For example, in the first embodiment, it is assumed that the first particles and the second particles have trajectories described as an example in the drawings, and that the first particles are in a magneto-Archimedes floating state in the vicinity of the wall portion (35). In this case, if the liquid surface of the supporting liquid (21) is set to be equal to or lower than the position at which the first particles float due to the magneto-Archimedes effect, the first particles placed via the hopper (33) horizontally travel toward the wall portion (35) while magnetically levitating at the liquid surface of the supporting liquid (21).

The first to the third embodiments described, as an example, a mixture containing two types of particles made of different substances, but there is no limitation on the types of particles contained in a mixture that is to be treated in the present invention and the number of types, as long as at least one type of particle is paramagnetic or diamagnetic. In the first to the third embodiments, the numbers of shelf boards (37) and suction tubes (51) and (53) are increased according to the types of particles contained in the mixture, and these constituent elements are arranged considering the trajectories of the particles. Note that, as described above, the particles separated by type may float stably due to the magneto-Archimedes effect in the separating tank (31) without providing the shelf board.

If ferromagnetic particles and paramagnetic or diamagnetic particles are contained in the mixture, the ferromagnetic particles are deposited on the bottom face of the separating tank (31) below the hopper (33). The paramagnetic or diamagnetic particles travel as described above and reach the shelf board (37) (or levitate stably at the wall portion (35) due to the magneto-Archimedes effect). Accordingly, also in this case, the mixture can be separated by particle type using the present invention.

In the present invention, in principle, there is no limitation on the size of particles contained in the mixture. However, it is not preferable for the particle size to be too large because the handling is not easy and the separating accuracy is adversely affected. The particle size will be preferably several millimeters or less. Furthermore, the particles contained in the mixture may be powder or crushed material, and there is no limitation on the shape of the particles contained in the mixture. For example, the mixture that is to be treated using the present invention may be formed by crushing or grinding waste containing a paramagnetic or diamagnetic metal. The mixture that is to be treated using the present invention may be obtained by treating slurry produced during machining such as polishing or cutting.

In the first to the third embodiments, the mixture is placed or introduced into the separating tank (31) using the hopper (33). However, in the present invention, there is no particular limitation on the means for introducing the mixture into the separating tank (31). For example, the mixture may be introduced into the separating tank (31) by intermittently pouring, into the separating tank (31), the supporting liquid (21) containing the mixture in a suspended state. Note that, in the present invention, the particles may rise once and then sink while horizontally traveling, depending on the position at which the mixture is placed or introduced into the separating tank (31).

In the first to the third embodiments, the particles are collected by type from the separating tank (31) using the suction tubes (51) and (53). However, in the present invention, there is no particular limitation on the means for collecting the separated particles. For example, a collecting net as in FIG. 4 of Patent Document 2 may be used. Furthermore, a scraper or the like may be used to scrape the separated particles out of the separating tank (31).

In the first to the third embodiments, it is possible to add a magnet that applies a force in the y direction to the particles, thereby more precisely controlling the movement of the particles. Note that, in the embodiments of the present invention, the orientation in which the gradient magnetic field is applied may be selected as appropriate.

As described above, according to the present invention, a mixture containing a plurality of types of particles made of different substances can be separated by type. As is easily seen from the description above, the present invention is applicable also to use in which a specific type of particle made of a paramagnetic or diamagnetic substance is to be separated from a mixture containing a plurality of types of particles made of different substances. It is clear that the mixture separating apparatuses of the first to the third embodiments can be used to separately collect only the first particles from the mixture. If the present invention is applied to such use, particles of types other than the particles that are to be separately collected may not be separated by type. For example, in the first to the third embodiments, if the mixture contains not only the first particles and the second particles but also third particles of a type different from these particles, the third particles may, together with the second particles, be allowed to sink while horizontally traveling in the supporting liquid (21), reach the bottom face (39) of the separating tank (31), and then travel on the bottom face (39) of the separating tank (31) toward the wall portion (35) (after which the third particles are collected together with the second particles by the suction tube (53)).

EXAMPLES

Hereinafter, specific examples of the present invention and experiments performed relating to the invention will be described.

Example 1

A superconducting magnet using a solenoid coil having a bore size of 100 mm was disposed such that the coil central axis was inclined by 30 degrees with respect to the vertical direction. As shown in FIGS. 1 and 2, a separating tank storing a 50 wt % aqueous solution of manganese chloride as the supporting liquid was disposed in the internal space surrounded by the superconducting magnet. The separating tank was made of transparent carbonate, and had a shape as shown in FIGS. 1 to 3. The separating tank had a width of 40 mm, a length of 40 mm, and a height of 50 mm, and a shelf board having a width of 15 mm was provided so as to project at a height of 25 mm from the bottom face.

A mixture of glass (silica) particles (diamagnetic substance) and alumina particles (diamagnetic substance) was prepared (see Table 1 for the density and the volume susceptibility of the glass (silica) and the alumina), electricity was supplied to the superconducting magnet, so that a magnetic field was generated downward, after which the mixture was placed into the separating tank from the opposite side to the shelf board. Both of the glass particles and the alumina particles were spherical, and had a particle size of approximately 1.5 mm. The magnetic field had a maximum value of 4 T at the coil or the magnet center, and had a magnitude in the x direction of 1 T and a magnitude in the z direction of 2 T at a location in the separating tank closest to the coil center (at a location corresponding to the right corner of the separating tank (31) shown in FIG. 2).

Figure 8:
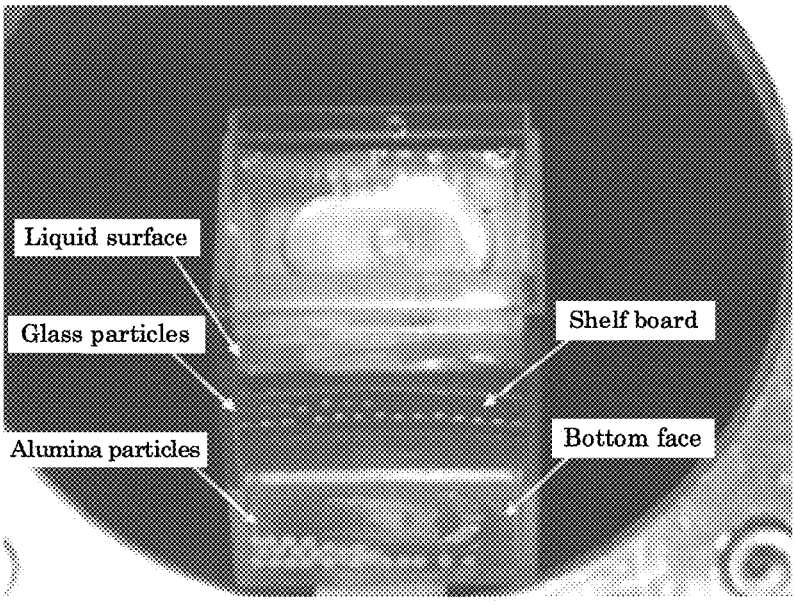
FIG. 8 is a photograph showing a state in which glass particles and alumina particles have been separated from each other in an example according to the first embodiment of the present invention.

The particles in the placed mixture sank in the supporting liquid while traveling toward a wall where a shelf board was provided so as to project from the wall. As shown in the photograph in FIG. 8, in the vicinity of the wall, the glass particles (glittering particles in FIG. 8) were gathered on the shelf board, and the alumina particles (white particles in FIG. 8) were gathered on the bottom face of the separating tank. In this manner, it was actually seen that, according to the present invention, a mixture of glass particles and alumina particles can be separated by particle type. Furthermore, it will be readily appreciated from the results of Example 1 that, according to the present invention, glass particles or alumina particles can be separated from a mixture containing glass particles or alumina particles.

Example 2

Figure 9:
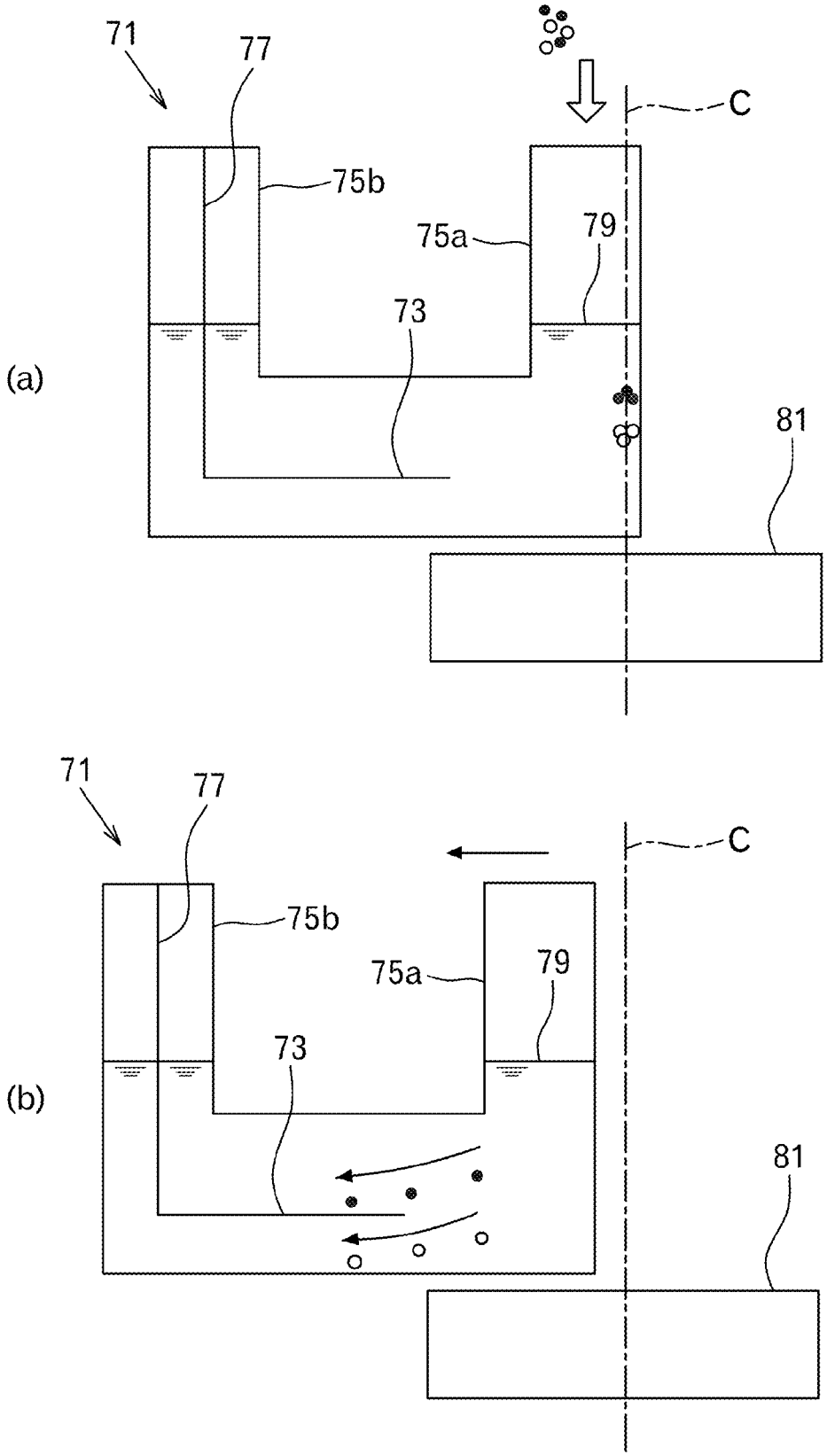
FIGS. 9(*a*) and 9(*b*) are explanatory views showing the outline of an example according to the third embodiment of the present invention.

FIGS. 9(*a*) and 9(*b*) are explanatory views schematically illustrating the outline of Example 2 corresponding to the third embodiment described above. A separating tank (71) approximately in a U shape was manufactured from transparent carbonate. The separating tank (71) had a length of 70 mm, a height of 60 mm, and a width of 2 mm, and a horizontal shelf board (73) was provided at a height of 10 mm from the bottom face. Extending portions (75*a*) and (75*b*) at both ends of the separating tank (71) had open upper ends. One of the extending portions, i.e., the extending portion (75*b*), was provided with a vertical partition plate (77) that was linked to the shelf board (73). The separating tank (71) stored a 50 wt % aqueous solution of manganese chloride as a supporting liquid (79).

A mixture of aluminum particles (paramagnetic substance) and titanium particles (paramagnetic substance) was prepared (see Table 1 for the density and the volume susceptibility of the aluminum and the titanium). As shown in FIG. 9(*a*), the mixture was placed via the opening of the extending portion (75*a*) into the separating tank (71) disposed over a superconducting bulk magnet (81). The aluminum particles were manufactured by crushing an aluminum ingot, and the titanium particles were manufactured by crushing a titanium ingot. These particles had a particle size of approximately 1 mm.

The superconducting bulk magnet (81) was columnar, and had a diameter of 60 mm. The superconducting bulk magnet (81) was magnetized using a solenoid superconducting magnet, and the magnitude of the magnetic field was approximately 3 T at the center of the pole end face. The separating tank (71) was disposed over the pole end face of the superconducting bulk magnet (81) such that the longitudinal direction of the separating tank (71) was along the radial direction of the superconducting bulk magnet (81). Moreover, the separating tank (71) was positioned with respect to the superconducting bulk magnet (81) such that the central axis C of the superconducting bulk magnet (81) passed through the separating tank (71) at a position slightly apart (by approximately several millimeters) from the inner wall of the extending portion (75*a*) of the separating tank (71).

Figure 10:
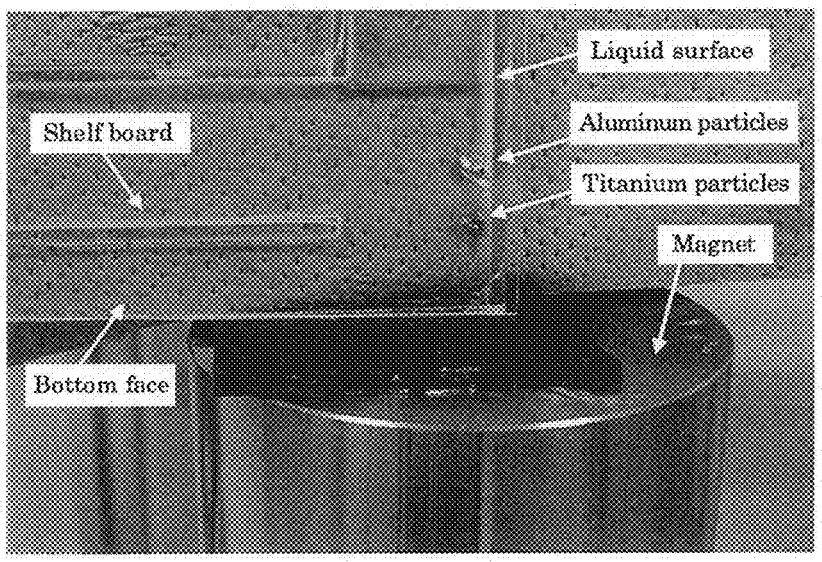
FIG. 10 is a photograph showing a state in which aluminum particles and titanium particles float in the supporting liquid in the example according to the third embodiment of the present invention.

As schematically shown in FIG. 9(*a*), the aluminum particles and the titanium particles placed into the separating tank (71) were gathered while floating stably due to the magneto-Archimedes effect at mutually different heights on the inner wall of the extending portion (75*a*). The aluminum particles floated at a height above the titanium particles. FIG. 10 is a photograph showing this state. From this state, as shown in FIG. 9(*b*), the separating tank (71) was slightly moved horizontally outward along the radial direction of the superconducting bulk magnet (81). The central axis C of the superconducting bulk magnet (81) shifted outside the separating tank (71), and was at a position apart from the outer face of the separating tank (71) by approximately several millimeters.

Figure 11:
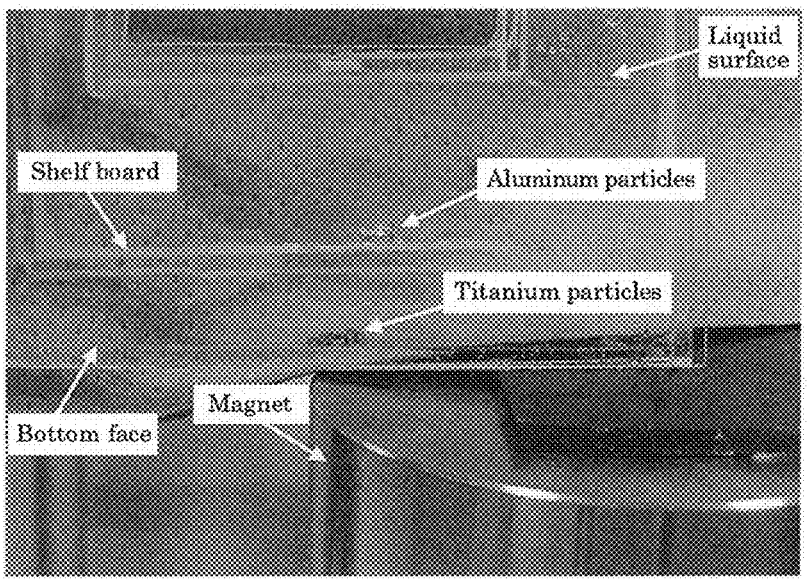
FIG. 11 is a photograph showing a state after aluminum particles and titanium particles have horizontally traveled in the example according to the third embodiment of the present invention.

When the separating tank (71) was moved, as schematically shown in FIG. 9(*b*), the aluminum particles and the titanium particles in the supporting liquid (79) sank while traveling toward the extending portion (75*b*). Thus, as shown in the photograph in FIG. 11, the aluminum particles were positioned on the shelf board (73), and the titanium particles were positioned on the bottom face of the separating tank (71) substantially below the aluminum particles. In this manner, it was actually seen that, according to the present invention, a mixture of aluminum particles and titanium particles can be separated by type. Furthermore, it will be readily appreciated from the results of Example 2 that, according to the present invention, aluminum particles or titanium particles can be separated from a mixture containing aluminum particles or titanium particles.

Example 3

Figure 12:
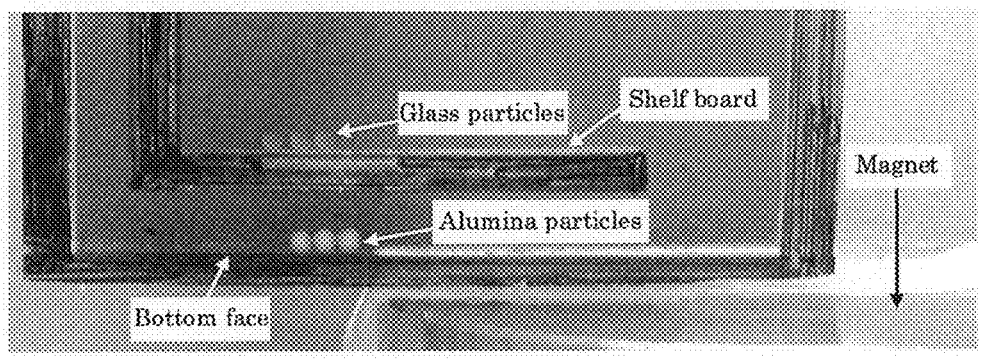
FIGS. 12(*a*) to 12(*c*) are photographs respectively showing states after glass particles and alumina particles have floated in the supporting liquid and horizontally traveled in the example according to the third embodiment of the present invention.
Figure 12:
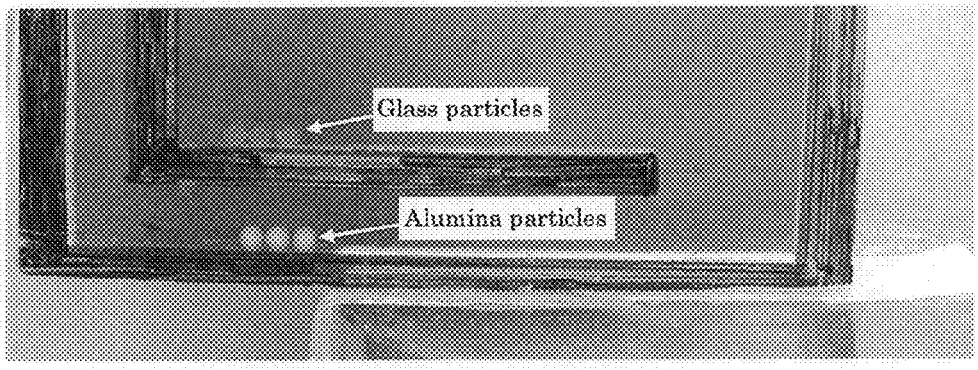
Figure 12:
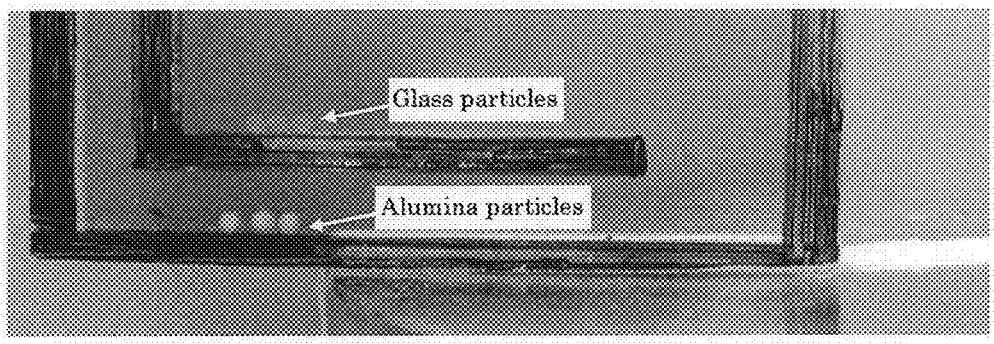

Treatment was performed as in Example 2, except that the mixture of glass particles and alumina particles of Example 1 was used, and that a 15 wt % aqueous solution of cobalt chloride was used as the supporting liquid (79). The glass particles and the alumina particles floated due to the magneto-Archimedes effect at mutually different heights as shown in FIG. 9(*a*), and then traveled in the horizontal direction (in the radial direction) while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 12(*a*).

Example 4

Treatment was performed as in Example 3, except that a 15 wt % aqueous solution of cobalt nitrate was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 12(*b*).

Example 5

Treatment was performed as in Example 3, except that a 20 wt % aqueous solution of nickel chloride was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 12(*c*).

Example 6

Figure 13:
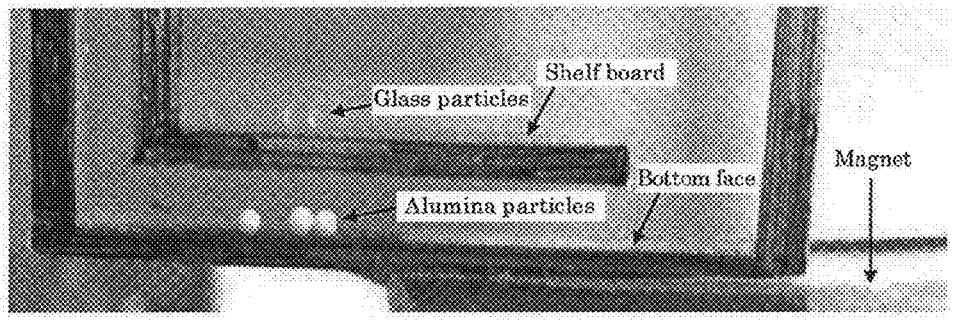
FIGS. 13(*a*) to 13(*c*) are photographs respectively showing states after glass particles and alumina particles have floated in the supporting liquid and horizontally traveled in the example according to the third embodiment of the present invention.
Figure 13:
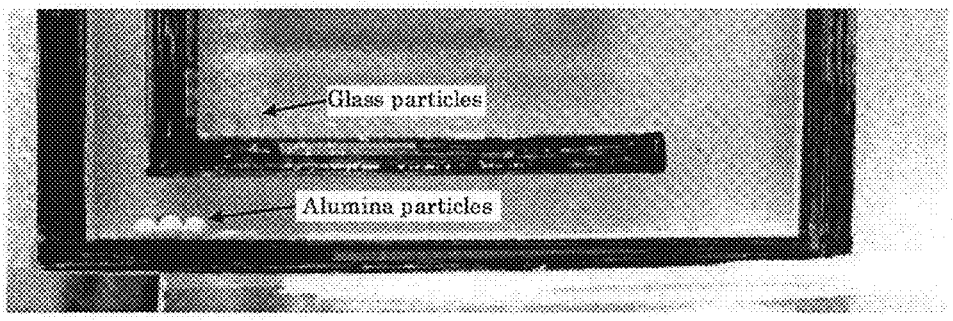
Figure 13:
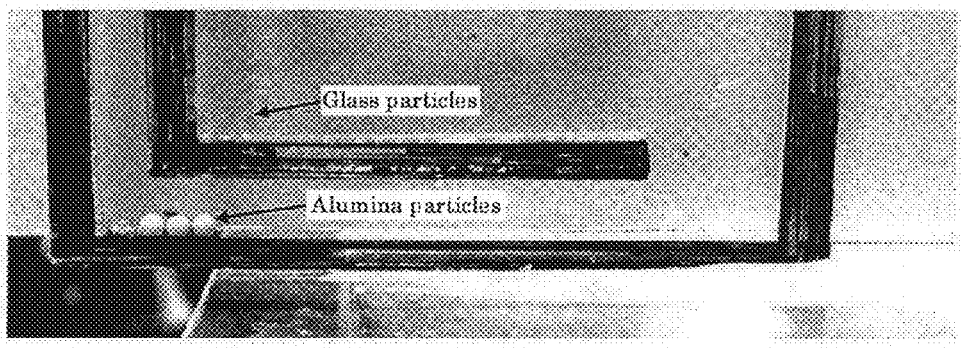

Treatment was performed as in Example 3, except that a 15 wt % aqueous solution of gadolinium nitrate was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 13(*a*).

Example 7

Treatment was performed as in Example 3, except that a 15 wt % aqueous solution of dysprosium nitrate was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 13(*b*) (a plastic thin plate was interspersed between the separating tank (71) and the superconducting bulk magnet (81) in FIG. 13(*b*); the same applies to FIGS. 13(*c*) and 14(*c*)).

Example 8

Treatment was performed as in Example 3, except that a 15 wt % aqueous solution of terbium nitrate was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 13(*c*).

Example 9

Figure 14:
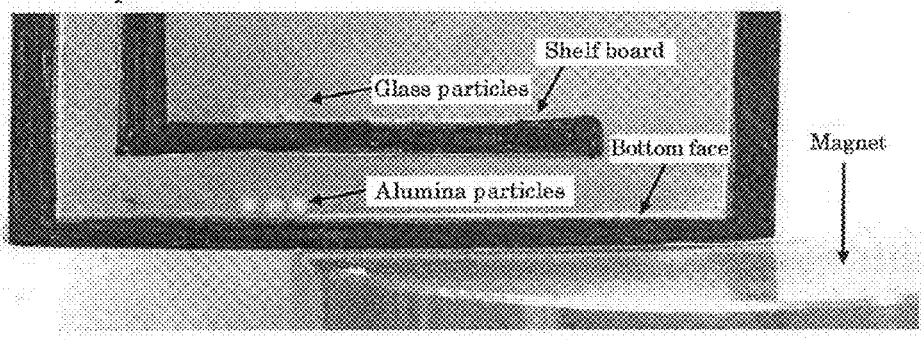
FIGS. 14(*a*) to 14(*c*) are photographs respectively showing states after glass particles and alumina particles have floated in the supporting liquid and horizontally traveled in the example according to the third embodiment of the present invention.
Figure 14:
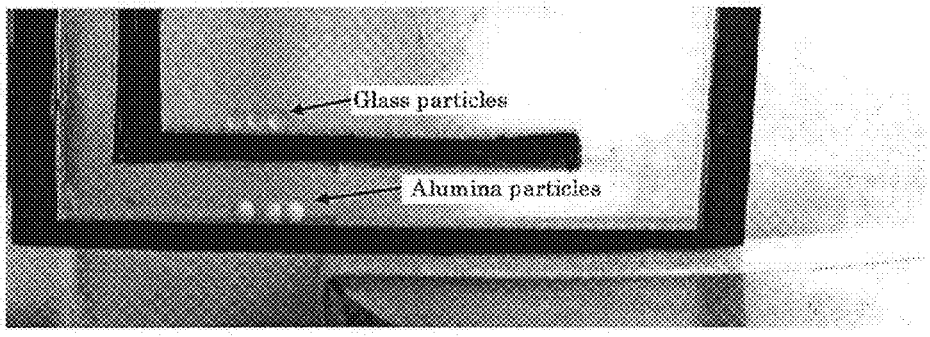
Figure 14:
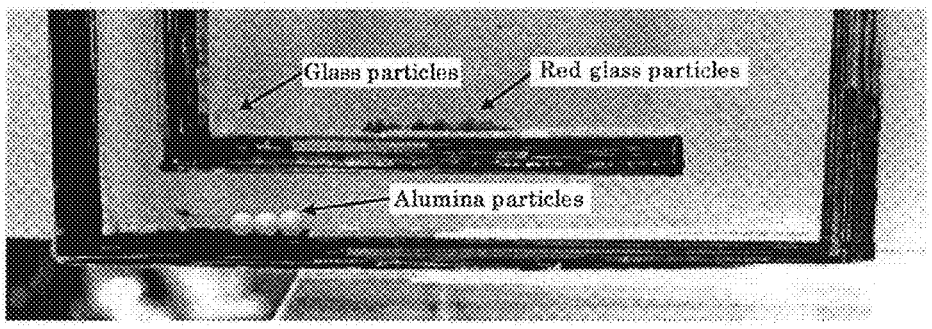

Treatment was performed as in Example 3, except that a 20 wt % aqueous solution of nickel nitrate was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 14(*a*).

Example 10

Treatment was performed as in Example 3, except that a 10 wt % aqueous solution of ferrous chloride was used as the supporting liquid (79). The glass particles and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles were positioned on the shelf board (73), and the alumina particles were positioned on the bottom face of the separating tank (71), as shown in the photograph in FIG. 14(*b*).

Example 11

Treatment was performed as in Example 2, except that a mixture prepared by adding red glass particles having a maximum particle size of approximately 1 mm to the mixture of glass particles and alumina particles of Example 1 was used, and that a 15 wt % aqueous solution of manganese chloride was used as the supporting liquid (79). The glass particles (and the red glass particles) and the alumina particles floated due to the magneto-Archimedes effect at mutually different heights as shown in FIG. 9(*a*), and then horizontally traveled while sinking in the supporting liquid (79) as shown in FIG. 9(*b*), after which the glass particles and the red glass particles were positioned on the shelf board (73), and the alumina particles were positioned on the bottom face of the separating tank (71), as shown in the photograph in FIG. 14(*c*).

Although an aqueous solution of manganese chloride was used as the supporting liquid in Examples 1 and 2, it was actually seen in Examples 3 to 10 that an aqueous solution of cobalt chloride, cobalt nitrate, nickel chloride, gadolinium nitrate, dysprosium nitrate, terbium nitrate, nickel nitrate, or ferrous chloride also may be used as the supporting liquid of the present invention. Also, it will be readily appreciated by those skilled in the art that the supporting liquid also may be an aqueous solution containing a plurality of types of paramagnetic inorganic salts selected from among manganese chloride, cobalt chloride, cobalt nitrate, nickel chloride, gadolinium nitrate, dysprosium nitrate, terbium nitrate, nickel nitrate, and ferrous chloride, and may be an aqueous solution containing a paramagnetic inorganic salt (for example, gadolinium chloride) other than the paramagnetic inorganic salt used in the examples. It will be appreciated from the comparison between Examples 1 and 2 and Example 11 that, in the present invention, the concentration of paramagnetic inorganic salt in the supporting liquid may be adjusted according to (substances forming) the mixture that is to be treated, the gradient magnetic field that is to be applied, the shape of the separating tank, and the like.

In Experiments 1, 2, 4, and 5 described below, particles contained in the mixture were separated by substance type using the magneto-Archimedes effect resulting from a gradient magnetic field having a vertical gradient. Furthermore, in Experiments 3 and 6, one type of particle floated stably using the magneto-Archimedes effect resulting from a gradient magnetic field having a vertical gradient. In Experiments 1 to 6, particles were not caused to horizontally travel as in the examples described above, but, as is readily appreciated from the description regarding the first to the third embodiments, the particles can be caused to horizontally travel by changing the device configuration employed in Experiments 1 to 6, such as providing the particles with a gradient magnetic field having a horizontal magnetic field gradient. It will be readily appreciated by those ordinarily skilled in the art that the results and the knowledge obtained from Experiments 1 to 6 can be applied to or used in the present invention.

Experiment 1

A mixture containing aluminum particles, titanium particles, alumina particles, and glass (silica) particles was placed into a 50 wt % aqueous solution of manganese chloride stored in a bottomed cylindrical glass container, and a vertically upward gradient magnetic field was applied thereto. Each of these various types of particles had a size of approximately 1 mm (the same applies to the other experiments). A columnar superconducting bulk magnet magnetized using a solenoid superconducting magnet was used to apply a gradient magnetic field, and a glass container storing an aqueous solution of manganese chloride into which the mixture had been placed was positioned at the center of the pole end face of the superconducting bulk magnet (see the photograph in FIG. 17, where the glass container was positioned on the superconducting bulk magnet via a sheet of black paper for photographic purposes).

FIG. 15 shows distributions of the magnitude of the magnetic field applied by the superconducting bulk magnet used in Experiment 1 and of a product of the magnitude of the magnetic field and the magnetic field gradient in the z direction. The magnetic field was 3.2 T on the pole end face of the superconducting bulk magnet (z=0), and monotonically decreased away from the end face toward the upper side (0.57 T when z=30 mm). The product of magnetic field and magnetic field gradient was −639.3 $T^2$/m on the pole end face of the superconducting bulk magnet (z=0), and monotonically increased away from the pole end face toward the upper side (−19.8 $T^2$/m when z=27 mm). FIG. 16 shows the distances from the end face of the superconducting bulk magnet and the corresponding values of the magnetic field, the magnetic field gradient in the z direction, and the product of magnetic field and magnetic field gradient.

When the gradient magnetic field shown in FIGS. 15 and 16 was applied to the mixture placed into a 50 wt % aqueous solution of manganese chloride, the aluminum particles, the titanium particles, the alumina particles, and the glass particles floated stably due to the magneto-Archimedes effect at mutually different heights as shown in the photograph attached as FIG. 17. Table 1 shows the density (g/$cm^3$), the volume susceptibility (SI unit system), and the floating position (the distance (mm) in the z direction from the end face of the superconducting bulk magnet) of these particles.

TABLE 1

| Particles | Density (g/$cm^3$) | Volume susceptibility | Floating height (mm) |
|---|---|---|---|
| Glass | 2.5 | −1.54E−05 | 32 |
| Aluminum | 2.69 | 2.06E−05 | 28 |
| Alumina | 3.97 | −1.80E−05 | 24 |
| Titanium | 4.50 | 1.80E−04 | 20 |

It will be appreciated from the results of Experiment 1 that, according to the present invention, a mixture containing aluminum particles, titanium particles, alumina particles, and glass particles can be separated by particle type, and a mixture containing diamagnetic particles and paramagnetic particles can be separated by particle type. Furthermore, it will be appreciated from the results of Experiment 1 that, according to the present invention, any type of particle can be separated from a mixture containing aluminum particles, titanium particles, alumina particles, and/or glass particles, and either diamagnetic particles or paramagnetic particles can be separated from a mixture containing diamagnetic particles and paramagnetic particles.

Experiment 2

A mixture containing copper particles (diamagnetic substance), lead particles (diamagnetic substance), and maghemite ($\gamma$-$Fe_2O_3$) particles (ferromagnetic substance) was placed into a 50 wt % aqueous solution of manganese chloride stored in the same type of glass container as in Experiment 1, and the same gradient magnetic field as in Experiment 1 was applied vertically upward thereto. Table 2 shows the density, the volume susceptibility (except for maghemite), and the floating position of these particles. Since the 50 wt % aqueous solution of manganese chloride has a susceptibility significantly smaller than that of maghemite, which is ferromagnetic substance, the maghemite particles were attracted by the superconducting bulk magnet and were deposited on the bottom portion of the glass container, whereas the copper particles and the lead particles floated at different heights, so that the particles were separated from each other.

TABLE 2

| Particles | Density (g/cm$^3$) | Volume susceptibility | Floating height (mm) |
|---|---|---|---|
| Copper | 8.93 | −9.65E−06 | 15 |
| Lead | 11.36 | −1.58E−05 | 13 |
| Maghemite | 5.3 | — | No floating |

It will be appreciated from the results of Experiment 2 that, according to the present invention, a mixture containing copper particles, lead particles, or maghemite particles can be separated by type, a mixture containing copper particles, lead particles, and maghemite particles can be separated by type, and a mixture containing diamagnetic particles and ferromagnetic particles can be separated by particle type. Furthermore, it will be appreciated from the results of Experiment 2 that, according to the present invention, copper particles or lead particles can be separated from a mixture containing not only copper particles or lead particles but also maghemite particles, and diamagnetic particles can be separated from a mixture containing diamagnetic particles and ferromagnetic particles.

Experiment 3

Silver particles (diamagnetic substance), gold particles (diamagnetic substance), and tungsten particles (paramagnetic substance) were separately placed into a 50 wt % aqueous solution of manganese chloride stored in the same type of glass container as in Experiment 1, and the same gradient magnetic field as in Experiment 1 was applied vertically upward thereto. Table 3 shows the density, the volume susceptibility, and the floating position of these particles.

TABLE 3

| Particles | Density (g/cm$^3$) | Volume susceptibility | Floating height (mm) |
|---|---|---|---|
| Silver | 10.50 | −2.42E−05 | 15 |
| Gold | 19.32 | −3.54E−05 | 12 |
| Tungsten | 19.30 | 7.76E−05 | 8 |

It will be appreciated from the results of Experiment 3 that, according to the present invention, a mixture containing tungsten particles, silver particles, or gold particles can be separated by particle type, a mixture containing tungsten particles, silver particles, and gold particles can be separated by type, and a mixture containing high-density particles can be separated by particle type. Furthermore, it will be appreciated from the results of Experiment 3 that, according to the present invention, any type of particle can be separated from a mixture containing tungsten particles, silver particles, or gold particles, and high-density particles can be separated from a mixture.

Experiment 4

A mixture containing aluminum particles and titanium particles was placed into an aqueous solution of manganese chloride stored in the same type of glass container as in Experiment 1, and the same gradient magnetic field as in Experiment 1 was applied vertically upward thereto. In Experiment 4, the levitation positions of the aluminum particles and the titanium particles were changed by changing the concentration of manganese chloride in the aqueous solution. Table 4 shows the concentration of manganese chloride in the aqueous solution and the floating position of the particles corresponding thereto.

TABLE 4

| | Concentration (wt %) | | | | | |
|---|---|---|---|---|---|---|
| | 50 | 40 | 33 | 28 | 25 | 22 |
| Aluminum | 28 mm | 19 mm | 18 mm | 18 mm | 18 mm | 17 mm |
| Titanium | 20 mm | 13 mm | 9 mm | 6 mm | 3 mm | No floating |

It will be appreciated from the results of Experiment 4 that, according to the present invention, the trajectories and the collecting locations of the particles in the supporting liquid can be adjusted or controlled, by changing the volume susceptibility and the density of the supporting liquid, more specifically, when using an aqueous solution of paramagnetic inorganic salts as the supporting liquid, by changing the concentration of paramagnetic inorganic salts.

Experiment 5

A mixture containing aluminum particles and titanium particles was placed into a 50 wt % aqueous solution of manganese chloride stored in the same type of glass container as in Experiment 1, and the same magnetic field as in Experiment 1 was applied vertically upward thereto. In Experiment 5, the magnetic field and the magnetic field gradient applied to the particles were changed by vertically changing the position of the glass container. Table 5 shows the magnetic field magnitude at the bottom face of the glass container and the floating position of the particles (from the bottom face of the glass container) corresponding to each pair of the magnetic field and the magnetic field gradient.

TABLE 5

| | Magnetic field (T) | | | | | |
|---|---|---|---|---|---|---|
| | 3.20 | 2.91 | 2.40 | 1.93 | 1.55 | 1.27 |
| Aluminum | 28 mm | 24 mm | 21 mm | 15 mm | 13 mm | 11 mm |
| Titanium | 20 mm | 13 mm | 10 mm | 6 mm | 3 mm | No floating |

It will be appreciated from the results of Experiment 5 that, according to the present invention, a specific type of particle in the mixture can be caused to float or levitate at the collecting locations or regions, whereas another type of particle can be allowed to sink or precipitate, these particles can be caused to float together at the collecting locations or regions, and, furthermore, the floating heights or durations of these particles can be adjusted or controlled, by controlling the gradient magnetic field that is applied to the particles.

Experiment 6

Silica particles were placed into a 25 wt % aqueous solution of ferrous chloride stored in the same type of glass container as in Experiment 1, and the same gradient magnetic field as in Experiment 1 was applied vertically upward thereto. In this case, the silica particles levitated stably at a height of 16 mm from the end face of the superconducting bulk magnet.

The description above has been given for illustrating the present invention, and should not be construed as limiting the invention described in the claims or as restricting the claims. Furthermore, it will be appreciated that the constituent elements of the invention are not limited to those in the foregoing examples, and various modifications can be made without departing from the technical scope described in the claims.

The invention claimed is:

1. A mixture separating method for separating, by type, a mixture containing at least two types of particles made of different substances using the magneto-Archimedes effect, or for separating particles of a specific type from the mixture using the magneto-Archimedes effect, particles of one type of the at least two types of particles being made of a paramagnetic or diamagnetic substance, and the particles of the one type having a density and a volume susceptibility different from a density and a volume susceptibility of particles of another type of the at least two types of particles, the method comprising:

(i) a step of applying a magnetic field whose magnetic field gradient has a vertical component and a horizontal component to a supporting liquid stored in a separating tank;

(ii) a step of placing the mixture into the supporting liquid to which the magnetic field has been applied, and guiding the particles of the one type such that the particles of the one type are positioned in the supporting liquid at a predetermined height from a bottom face of the separating tank; and (iii) a step of collecting the particles of the one type positioned at the predetermined height, wherein the guiding the particles of the one type in step (ii) comprises a step of putting the particles of the one type in a floating state due to the magneto-Archimedes effect, and applying a horizontal force to the particles of the one type, the horizontal force resulting from the magnetic field and being proportional to a difference in volume susceptibility between the particles of the one type and the supporting liquid, thereby causing the particles of the one type to horizontally travel while sinking to the predetermined height, with the floating state due to the magneto-Archimedes effect being maintained, and the particles of the another type are positioned at a position vertically different from that of the particles of the one type, between the bottom face of the separating tank and a liquid surface of the supporting liquid.

2. The mixture separating method according to claim 1, wherein the separating tank is provided with a substantially horizontal shelf board, and the particles of the one type sink in the supporting liquid and are positioned on the shelf board.

3. The mixture separating method according to claim 1, wherein the particles of the one type float stably at the predetermined height in the supporting liquid.

4. The mixture separating method according to claim 1, wherein the magnetic field is generated using magnetic field generating means having a superconducting bulk magnet or having a solenoid coil with a coil central axis inclined with respect to the vertical direction.

5. The mixture separating method according to claim 1, wherein the magnetic field is obtained by composition of a first magnetic field generated by first magnetic field generating means and a second magnetic field generated by second magnetic field generating means, and the first magnetic field has a magnetic field gradient oriented in the vertical direction and the second magnetic field has a magnetic field gradient oriented in the horizontal direction.

6. The mixture separating method according to claim 1, wherein the guiding step comprises a step of putting the particles of the another type in a floating state due to the magneto-Archimedes effect, and applying a horizontal force proportional to a difference in volume susceptibility between the particles of the another type and the supporting liquid and resulting from the magnetic field to the particles of the another type, thereby causing the particles of the another type to horizontally travel while sinking, with the floating state due to the magneto-Archimedes effect being maintained.

7. The mixture separating method according to claim 1, wherein the supporting liquid is an aqueous solution containing at least one type of inorganic salt selected from the group consisting of manganese chloride, cobalt chloride, nickel chloride, ferrous chloride, cobalt nitrate, nickel nitrate, gadolinium nitrate, dysprosium nitrate, and terbium nitrate.

* * * * *